United States Patent [19]

Raymond

[11] 3,956,537

[45] May 11, 1976

[54] METALLIC COATING OF METAL TUBES AND SIMILAR WORK PIECES

[76] Inventor: Anthony John Raymond, 20429 Attica Road, Olympia Fields, Ill. 60461

[22] Filed: Apr. 22, 1974

[21] Appl. No.: 462,874

Related U.S. Application Data

[63] Continuation-in-part of Ser. No. 350,535, April 12, 1973, Pat. No. 3,877,975.

[52] U.S. Cl. ..... 427/433; 427/434; 427/436; 427/321; 118/405; 118/DIG. 12; 118/429

[51] Int. Cl.[2] ..... C23C 1/00; B05C 11/10; B05C 3/02

[58] Field of Search..... 117/114 RA, 102 L, 102 M, 117/102 A; 118/404, 405, 429, 63, 125, DIG. 11, DIG. 12; 427/433, 434, 436

[56] References Cited

UNITED STATES PATENTS

| | | | |
|---|---|---|---|
| 3,533,761 | 10/1970 | Pierson | 118/405 |
| 3,597,261 | 8/1971 | Coburn et al. | 118/63 |

*Primary Examiner*—Mayer Weinblatt
*Assistant Examiner*—Edith Buffalow
*Attorney, Agent, or Firm*—Kinzer, Plyer, Dorn & McEachran

[57] ABSTRACT

A method and means of continuously applying molten coating metal, as in galvanising of tubes or members passing through the galvanising bath in a straight line. The molten metal in a reservoir is discharged onto the tube or rod; flow around the tube or rod is controlled by a splash tube. A coating of desired thickness is attained by use of a cooperating die and air knife.

9 Claims, 3 Drawing Figures

METALLIC COATING OF METAL TUBES AND SIMILAR WORK PIECES

This application is a continuation-in-part of application Ser. No. 350,535 filed Apr. 12, 1973 now U.S. Pat. No. 3,877,975.

In the art of galvanising steel tubes by the application of molten zinc, one of the problems which exists is the surrounding of the tube with the galvanising material without the tube being bent to pass through a trough or the like as has been customary when galvanising continuous lengths of wire or strip.

It will be realised that in the galvanising of wires or strips no problem exists as the wire or strip can be bent by passing it over guide rollers to extend down into the galvanising bath and can then be guided along the bath and taken out of the bath at the other end by again passing around appropriately positioned guide rollers. When it is necessary to galvanise tubing or larger rods or members which cannot be bent, and which have a length such that they cannot be submerged in the bath, the method used for galvanising is to pass the products through a trough which has closed ends and sides and into which the galvanising liquid is pumped. The trough has apertures in its end so that the tube can pass into the trough at one end and out at the other with a minimal spill of galvanising through the apertures.

Processes of the type described are used particularly in the continuous formation of tubes which are then galvanised and cut into length. The tubes are formed from flat strip passed through forming guides and bent to tubular form. The joint is then welded to give a continuous tube, means being used to cut off any projecting metal at the weld. The tube is then usually heated by induction in an inert atmosphere and is passed into the galvanising section in which the trough is positioned above the level of the molten zinc in the kettle. This section is usually also maintained in an inert atmosphere by enclosing the top of the kettle and the trough. On leaving the trough, excess zinc is removed from the tube by means of an air knife or the like surrounding the tube. The excess zinc flows back into the kettle. The tube passes out of this zone to a flying shear which cuts the galvanised tubing to length.

The present invention relates generally to this type of process but is not necessarily limited thereto as it can be applied anywhere where tube or conduit or rod or the like, which will generally be referred to as a "work piece" requires to be continuously passed through a metal coating zone while maintaining linear alignment of the work piece being coated.

Certain objections exist to the use of a trough which has ends and sides and has sealed apertures through which the work piece to be treated must pass. One difficulty is to obtain optimum size of the apertures in relation to the tubing to ensure that especially at the exit end the coat of galvanising material which has been applied to the work piece will not be disturbed or adversely affected. More significantly perhaps, the seals are responsible for wiping the tube such that the amount of coating metal remaining (0.8 ounces/ft$^2$ at best) is far less than the proscribed optimum, considered as 1 – 1¼ ounces/ft$^2$.

A further problem exists in that it is necessary to supply sufficient zinc to the trough to cause the level to be maintained well above the work piece, and to maintain a sufficient flow by pumping excess zinc to the trough to ensure that the level will be maintained and also to ensure that there will be a correct temperature gradient over all parts of the trough for most effective galvanising.

These and other problems are overcome by the present invention which is preferably applied to the galvanising of tubes or similar work pieces of a rigid nature such that they must be fed through the galvanising bath without disturbing the linear alignment, but it is to be clear that the invention need not necessarily be limited to the galvanising of tubing formed by wrapping and welding strip which eventually, after galvanising, is cut into lengths.

SUMMARY OF INVENTION

The process according to the present disclosure consists of flowing the molten metal (e.g. galvanising material) over the work piece from a reservoir while using a splash plate in the form of a tube to direct the flow around the work piece in the most effective manner.

The splash tube is connected to a reservoir to receive the molten galvanising material from slots or apertures in the reservoir. The space between the splash plate and the work piece can be relatively narrow as the supply of the galvanising fluid is constantly replenished from the reservoir.

The hot molten metal which may be zinc, or zinc with an additive such as aluminum, flows from the reservoir where it is maintained at the correct temperature by heating means, and into which it is pumped from a kettle in regulated quantities. Molten metal flows from the bottom of the reservoir over the work piece as it moves in a straight line beneath the reservoir. To control the flow around the work piece, the splash plate is used to ensure that the work piece is completely surrounded by the galvanising fluid. Because the splash plate can have relatively small dimensions between the splash plate and the work piece, longitudinal flow can be induced in the galvanising medium, controlled in its direction by shaping of the splash plate or by inclining the splash plate.

The apertures in the reservoir through which the flow takes place on to the work piece can be variously positioned and can be of different shape.

To assure a coating thickness of the desired dimension, the tube coated with molten metal is fed through a sizing die and is afterwards exposed to an air knife. This takes place outside the housing which covers the reservoir and tubular splash plate.

Further details of the invention will be appreciated from a description which will be made of preferred forms illustrated in the accompanying drawings.

DESCRIPTION OF PREFERRED EMBODIMENT

Figures 1, 2, 3:
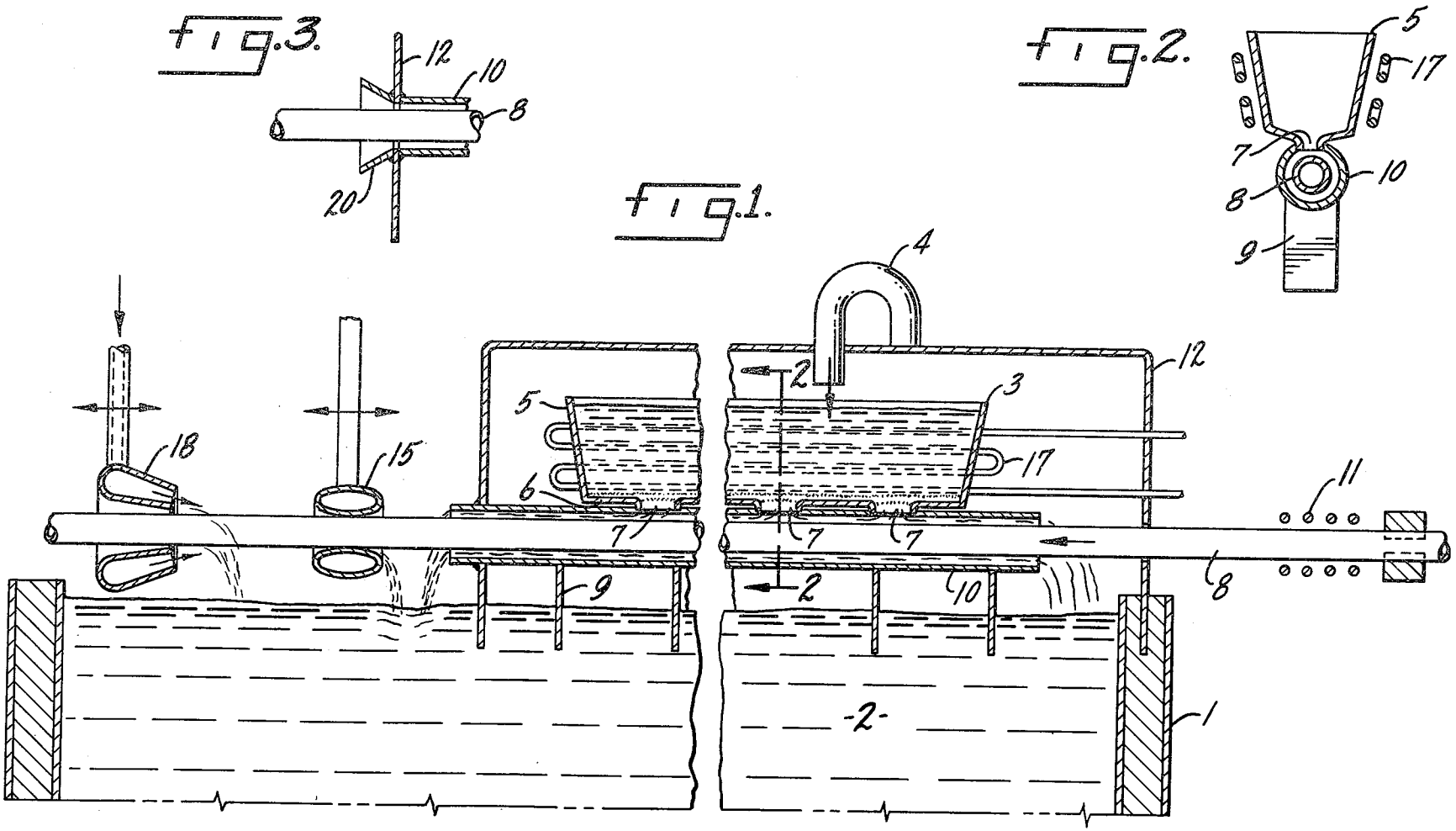
FIG. 1 is a schematic sectional side elevation of a tube galvanising plant conforming to the present invention.
FIG. 2 is a section of the reservoir and tube and splash plate on line 2—2 of FIG. 1.
FIG. 3 shows a modified form of the invention.

In the embodiment shown in FIG. 1 a kettle 1 has in it the molten galvanising fluid 2 which is pumped by any convenient pumping device to the reservoir 3 through the pipe 4.

The reservoir comprises walls 5 at the sides and ends and a bottom 6 which has in it a series of apertures 7 through which molten material pumped into the reservoir flows onto the tube 8 which forms the work piece in this case, the tube 8 being, however, surrounded on its underside and sides by a tubular splash plate 10 which has spaced openings at the top so that the fluid from the reservoir can flow into the splash plate through slots 7 and is then guided around the tube by the splash plate 10.

It will be noted the right hand end of the splash plate is unobstructed whereby fluid control can be effected by the size and positioning of the apertures 7 and also by the proximity of the splash plate to the tube 8 being treated.

As shown in FIG. 1, the level of molten coating metal should be as close as practical to the underside of the splash plate to maintain the splash plate hot thereby to prevent chilling and freezing of the molten metal in contact with the splash plate. In this same connection, heat exchangers as the plates 9, extend from the splash plate into the body of molten metal in the kettle.

A preheating induction coil 11 is shown surrounding the tube 8 as it enters the galvanising area, this being general practice as it is necessary to raise the tube 8 to a selected temperature to ensure correct galvanising.

As the galvanising is preferably carried out in an inert atmosphere, a cover 12 encloses the space above the kettle 1, including the reservoir and galvanising area. To smooth the coating, to wipe globules and to assure a coating of the desired thickness among other things, tube 8 is passed through a circular die 15 of non-corrodable material, a ceramic for example, located outside the housing or cover 12.

Any additional excess of galvanising fluid, in excess of the desired thickness, is removed from the tube 8 by any of the known sizing means, but in the illustration an air knife 18 is located downstream of die 15 to apply an annulus of air which removes any excess galvanising material, which returns to the kettle, and concurrently freezes the remainder. Guides may be used for the tube.

Heater elements 17 surround the reservoir to maintain the molten galvanising fluid at the required temperature.

The exact mode of practice can be varied quite considerably, but the basic principle is maintained under which the tubular or other work piece does not pass through a trough containing the molten coating metal, and which under the prior art condition is required to be maintained beneath the fluid level therein.

The reservoir merely serves as a means of supply of molten metal flowing through apertures or slits in the reservoir downward onto the work piece which passes beneath the reservoir and thus has a flow over the work piece for the purposes of effecting galvanising. In this connection it will be observed in FIG. 1, the splash plate extends outside the housing 12 but terminates upstream of the die 15. Consequently, molten coating metal collected on and surrounding tube 8 cascades from the left hand end of the splash plate, falling into the main supply. The collected metal thereby seals the annular space between the work piece 8 and the open end of the tubular splash plate 10.

According to the disclosure in my earlier filed application, the left end of the splash plate terminates inside the housing or cover, and is spaced from a seal through which the coated work piece exits. The seal is attached to the inside end wall of the housing. There, the coating thickness is principally a function of the distance separating the internal seal and the adjacent end of the splash plate, plus the radial space between the splash plate and the work piece. The radial space determines the thickness of metal picked up and dragged along by the work piece; the distance separating the seal and adjacent end of the splash plate can be viewed as a time span during which the molten metal transforms from liquidus to solidus. For a given alloy and a given temperature gradient, the greater the separation distance the more time to reach the solid state and therefore less molten metal will be wiped off by the die as the coated work piece emerges from the housing. This arrangement, disclosed in the earlier filed application, is particularly applicable to tubular work pieces of relatively large diameter, where a thick coating thickness is easily controlled by varying the dimensions.

The present disclosure is particularly applicable to tubular work pieces of small diameter where the function of die 15, located outside the housing, is to preliminarily size the molten metal on the tubing or work piece into a smooth, thick, even coating as the molten metal approaches the plastic state. The air ring or knife 18 located downstream determines the final coating thickness by the amount of metal removed which can be varied by the air pressure, and its temperature and its proximity to the preliminary wiping die. The air ring 18 also acts to freeze the coating. The die can be heated to retard the solidus state.

In the known instance of using a trough with exit and entrance apertures as in U.S. Pat. No. 3,122,114, the required sealing of the trough, to maintain the level of the molten metal well above the tubing, and the fluidity of the molten metal at the exit aperture of the trough, greatly limits the quantity of molten metal on and about the tubing as it leaves the coating or galvanizing section and thus the thickness of coating attainable is inherently limited.

This problem of limited coating thickness was solved in my earlier filed application by elimination of entry and exit apertures which allowed latitude in design of the resulting reservoir and splash plates so as to afford longitudinal distance (and therefore time for the molten metal to approach the plastic state) between the coating or galvanizing section and the wiper seal as noted above. It also allowed a completely open exit from the splash plate so as not to inhibit or limit the amount of molten metal on the tubing or work piece, characterizing applicability to large diameter work pieces, 6 inches or more in diameter.

The present application deals with an additional improvement particularly applicable to tubing diameters up to 6 inches and the advantages are manifold:

1. The elimination of the combination of wiper and seal (part 16 in my earlier filed application) for maintaining the inert atmosphere;

2. By eliminating the combined wiper and seal, it is now possible to adjust both the preliminary wiper 15 and the air ring or knife 18 both longitudinally and about the periphery of the tubing or work piece, and accurately control and vary coating thickness. The ideal position of the preliminary wiper and air ring will vary for different work piece diameters and also for different production speeds of the same diameter.

Thus, I can eliminate the sealing function of the combined wiper and seal of the earlier application by utilizing a tubular splash plate which extends through the end wall of the upper housing, protruding out several inches, and is sealed at the point of exit, to the end wall by either a mechanical seal or by welding as shown. The continuous flow of the molten metal from the reservoir through the tubular splash plate prevents the escape of the inert atmosphere through the tubular splash plate.

The 6 inch diameter limitation (or near to it) exists because the practical clearances required between the tubular splash plate and the tubing or work piece will become greater as the diameter increases. Any diameter above 6 inches will require such a great volume of molten metal flowing through the reservoir and splash plate to maintain continuity of seal that the method described in the earlier filed application would be more desirable.

Instead of extending the splash plate through the housing the terminal end could be sealed to the inside of the housing. A funnel-shaped member 20, FIG. 3, could be attached to the outside of the housing to protect the housing from the galvanizing metal.

I claim:

1. The method of continuously applying a molten metal coating to a metal tube or other work piece passing through the coating metal in a straight line within a housing, the housing having an entrance opening at one end to admit the work piece and an opening at the opposite end, comprising: heating the metal in a kettle to provide a body of liquid metal, pumping the molten metal into a reservoir within the housing disposed above said kettle, allowing a controlled stream of molten metal to flow downward from said reservoir, passing the work piece through the housing and beneath said reservoir to allow the molten metal to flow over and coat said work piece, disposing a splash plate at least beneath said work piece inside the housing to control the flow of molten metal around said work piece, said splash plate being extended at least to said opening at the opposite end of the housing to seal that opening, feeding the coated work piece through an adjustable sizing die outside the housing, and adjusting the sizing die longitudinally of the work piece and relative to the adjacent end of the splash plate to control the thickness of metal applied to the work piece.

2. The method of claim 1 wherein said splash plate is of tubular form surrounding the work piece, said splash plate having at least one opening in communication with said reservoir to allow molten metal to flow around said work piece.

3. The method of claim 1 wherein an adjustable air knife is located downstream of the die and wherein the air knife is adjusted to vary its spacing from the die and from the end of the housing where the coated work piece emerges.

4. The method of claim 2 wherein an adjustable air knife is located downstream of the die and wherein the air knife is adjusted to vary its spacing from the die and from the end of the housing where the coated work piece emerges.

5. The method of claim 4 wherein the end of the splash plate whereat the coated work piece emerges is sealed by molten metal collected on the work piece.

6. The method of claim 1 wherein the end of the splash plate whereat the coated work piece emerges is sealed by molten metal collected on the work piece.

7. The method of continuously galvanising a steel tube or other work piece passing through a galvanising bath within a housing after entering from one side thereof comprising: supplying the molten galvanising medium to a reservoir within said housing, coating the work piece by allowing a stream of galvanising medium to flow downward from said reservoir through an opening in said reservoir and into a splash plate beneath said reservoir and through which the work piece is passed, attaching the splash plate in sealed relation to an opening at the opposite side of the housing to afford egress of the work piece from the splash plate outward of the housing, passing the coated work piece emerging from the splash plate outward of said sealed opening through a die located outside said housing, and adjusting the die longitudinally of the work piece and relative to the splash plate to control the thickness of metal applied to the work piece.

8. The method of claim 7 wherein collected metal on the work piece as it emerges from the housing and is fed to the die seals the area between the work piece and the splash plate.

9. The method of claim 8 wherein an air knife is adjusted downstream of the die wipe excess unfrozen metal from the work piece.

* * * * *